US006213813B1

(12) United States Patent
Huang

(10) Patent No.: US 6,213,813 B1
(45) Date of Patent: Apr. 10, 2001

(54) ARRANGEMENT FOR POSITIONING AND SHIELDING STACKED ELECTRICAL CONNECTORS

(75) Inventor: Nan Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/464,883

(22) Filed: Dec. 16, 1999

(51) Int. Cl.[7] ..... H01R 13/648
(52) U.S. Cl. ..... 439/607; 439/541.5
(58) Field of Search ..... 439/541.5, 607, 439/609, 608, 610, 701

(56) References Cited

U.S. PATENT DOCUMENTS 5,037,330 * 8/1991 Fulponi et al. ..... 439/541.5
5,637,015 * 6/1997 Tan et al. ..... 439/607
5,755,595 * 5/1998 Davis et al. ..... 439/607
5,797,770 * 8/1998 Davis et al. ..... 439/607
6,027,375 * 8/1991 Wu ..... 439/607

* cited by examiner

*Primary Examiner*—Gary F. Paumen
(74) *Attorney, Agent, or Firm*—Wei Te Chung

(57) ABSTRACT

A stacked connector assembly comprises upper and lower connectors, a positioning and shielding arrangement for positioning and shielding the upper and lower connectors. The positioning and shielding arrangement includes a positioning frame for positioning the upper and lower connectors and a common shield for shielding the stacked connector assembly. The positioning frame forms a rear base wall for preventing the upper and lower connectors from withdrawal when corresponding mating connectors are made to engage with the upper and lower connectors, and a partition extending forward from a middle portion of the rear base wall for supporting the upper connector thereon. A positioning member extends forward from a middle portion of the partition for preventing the upper and lower connectors from rotation. Corresponding upper and lower shells of the upper and lower connectors electrically contact with the common shield thereby forming a complete shielding system for the stacked connector assembly.

2 Claims, 5 Drawing Sheets

ARRANGEMENT FOR POSITIONING AND SHIELDING STACKED ELECTRICAL CONNECTORS

FIELD OF THE INVENTION

The present invention relates to an arrangement for positioning and shielding stacked electrical connectors, and particularly to a positioning and shielding arrangement for combining upper and lower connectors together into an integral stacked connector assembly.

BACKGROUND OF THE INVENTION

In compliance with the miniaturization trend of electronic devices, stacked connectors are commonly adopted. An example of stacked connector assembly is disclosed in U.S. Pat. No. 5,037,330. As shown in FIG. 6, the stacked connector assembly comprises upper and lower circular DIN connectors 2' and 3', a connector supporting housing 4' and a common metal shield 1'. The connector supporting housing 4' forms upper and lower chambers 41' and 42' for receiving the upper and lower connectors 2', 3'. A connector support gantry 43' outwardly extends from the connector supporting housing 4' for supporting the upper connector 2'. The connector supporting housing 4"includes upper and lower comb sections 44', 45'for separating corresponding terminals (not shown) of the upper and lower connectors 2' and 4' from each other.

However, it is very easy for the upper and lower connectors 2', 3' to be forcibly moved rearward when engaging with mating connectors (not shown), for the upper and lower connectors 2', 3' are not firmly secured the upper and lower chambers 41', 42' of the connector supporting housing 4'. The movement of the upper and lower connectors 2', 3' will result in poor electrical engagement between the mating connectors and the upper and lower connectors 2', 3'.

Furthermore, the upper and lower connectors are also apt to rotate due to the lack of corresponding positioning structure, thereby causing poor signal transmissions therethrough.

Therefore, the present invention provides an improved positioning and shielding arrangement to properly position stacked connectors thereby solving the above questions.

BRIEF SUMMARY OF THE INVENTION

An object of the present invention is to provide an improved arrangement for properly positioning and shielding stacked connectors thereby ensuring a good signal transmission therethrough.

Another object of the present invention is to provide a stacked connector assembly having an improved positioning and shielding arrangement thereby preventing the stacked connectors from undesired rotation and movement when engaging with mating connectors.

Another object of the present invention is to provide a stacked connector assembly having excellent electrical shielding properties.

A stacked connector assembly in accordance with the present invention comprises upper and lower connectors retained in positioning and shielding arrangement. The positioning and shielding arrangement includes a positioning frame for properly positioning the upper and lower connectors and a common shield for shielding the stacked connector assembly. The positioning frame forms a rear base wall for preventing the upper and lower connectors from moving when engaging with mating connectors, and a partition extending forward from a middle portion of the rear base wall for supporting the upper connector thereon. A positioning member extends forward from a middle portion of the partition for preventing the upper and lower connectors from rotation. The upper and lower connectors have corresponding upper and lower shells, respectively. The upper and lower shells are in electrical connection with the common shield thereby forming a complete shielding system for the stacked connector assembly.

Other objects, advantages and novel features of the invention will become more apparent from the following detailed description when taken in conjunction with the accompanying drawings.

DETAILED DESCRIPTION OF THE INVENTION

Figure 1:
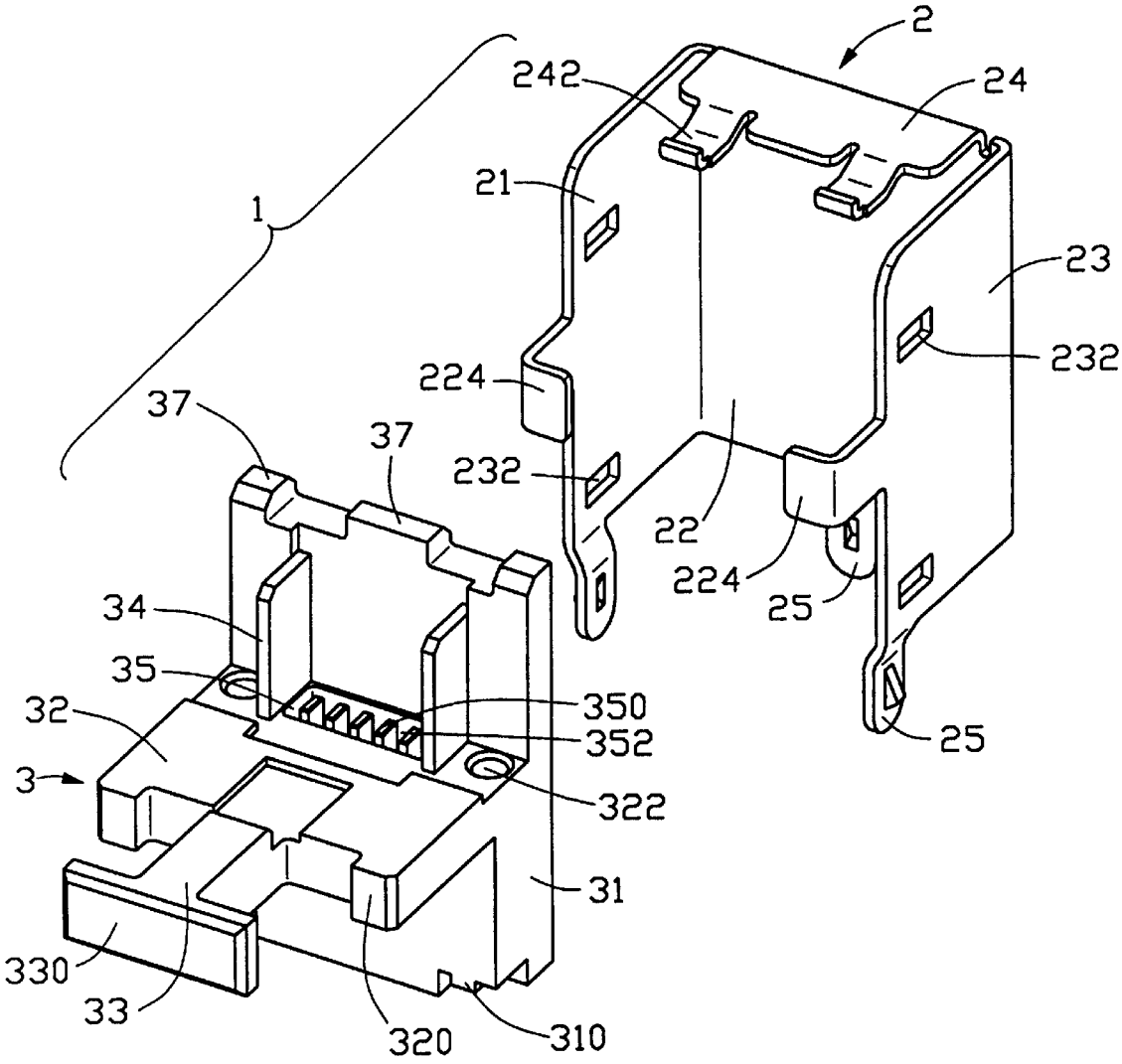
FIG. 1 is an exploded view of a positioning and shielding arrangement in accordance with the present invention.
Figure 5:
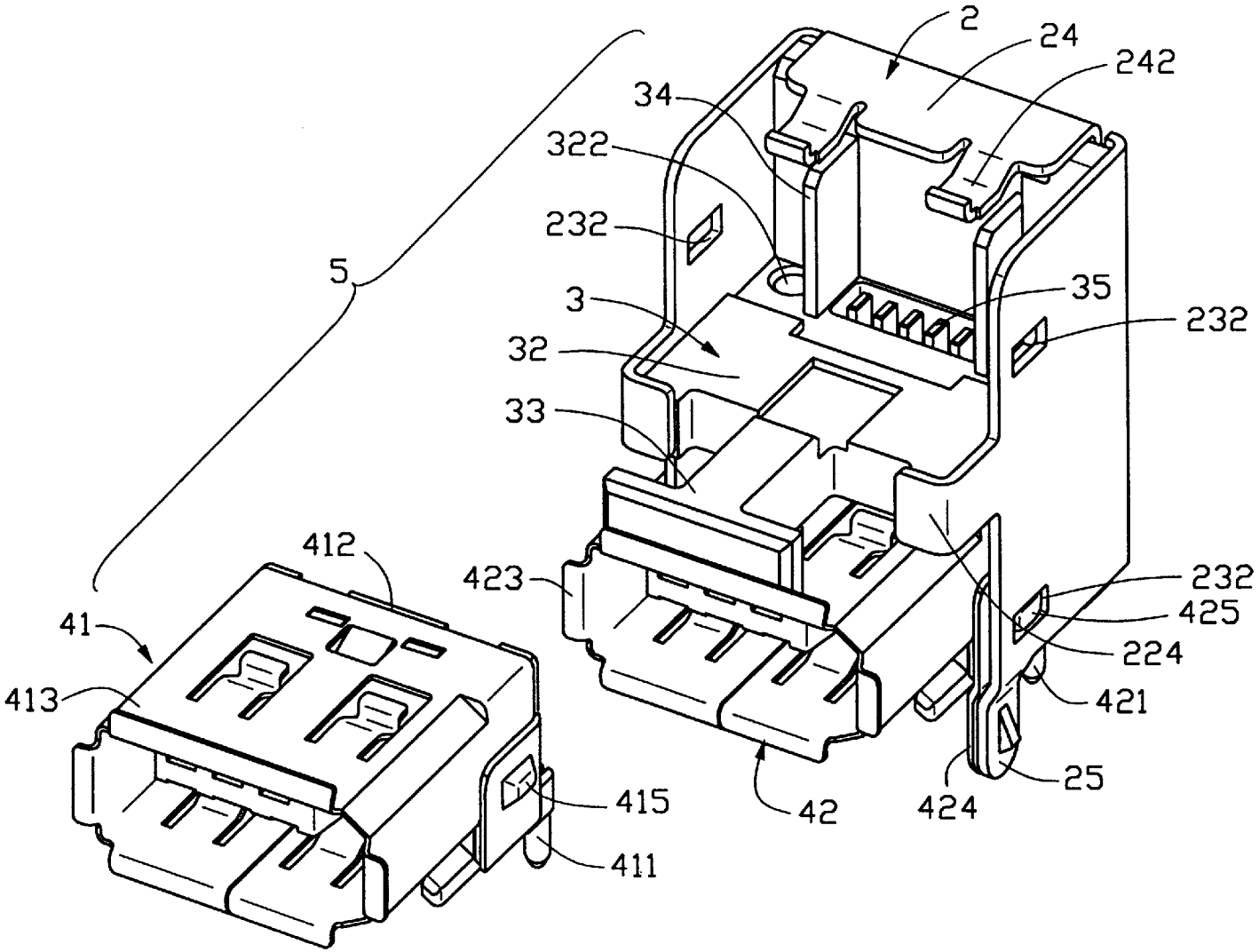
FIG. 5 is a partially assembled view of a stacked connector assembly in accordance with the present invention.
Figure 6:
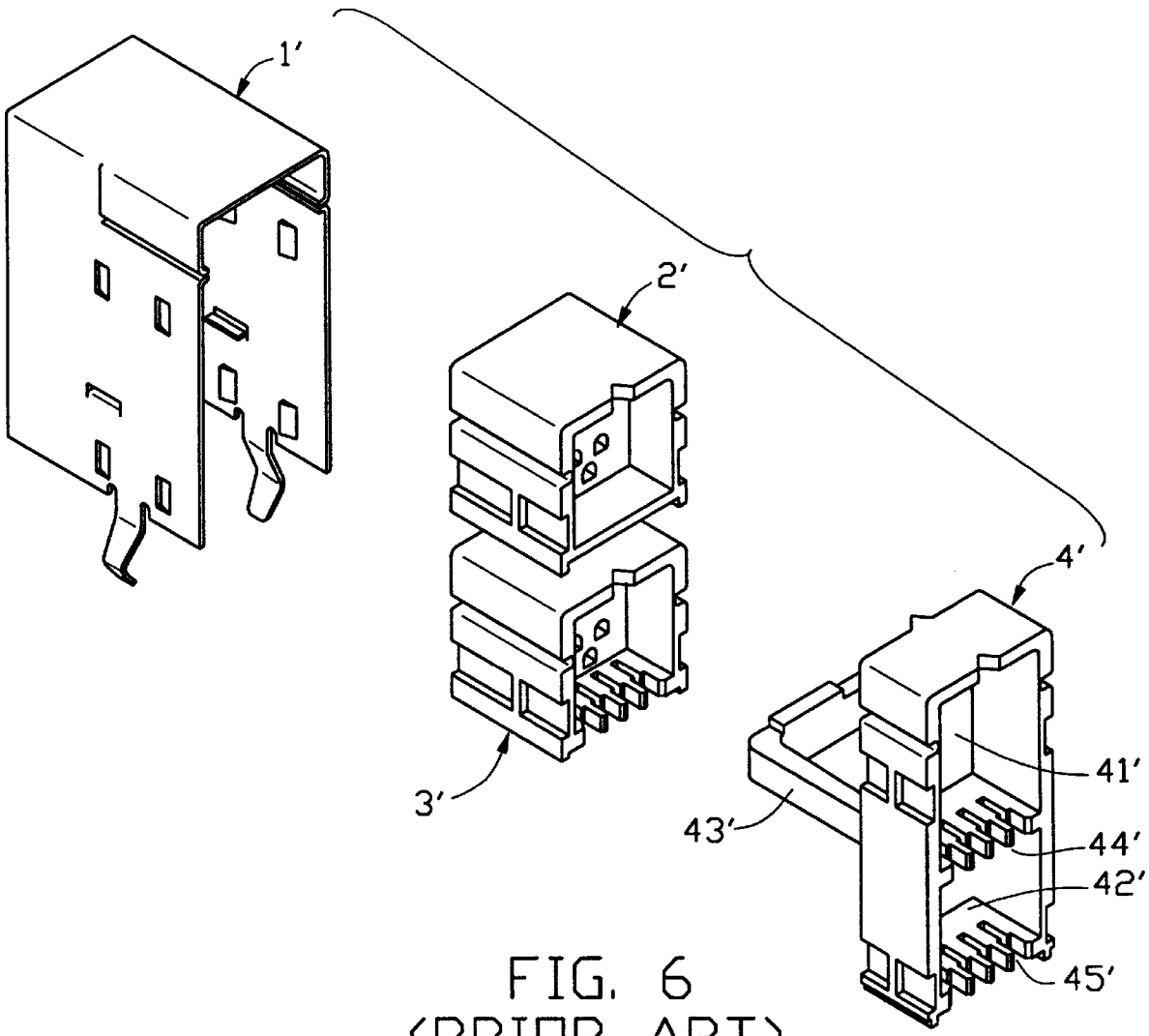
FIG. 6 (PRIOR ART)
FIG. 6 is an exploded view of a conventional stacked connector assembly.

Referring to FIGS. 1 and 5, a positioning and shielding arrangement 1 in accordance with the present invention comprises a common shield 2 and a positioning frame 3. The common shield 2 defines an interior space (not labeled) for receiving the positioning frame 3 therein. A pair of upper and lower electrical connectors 41, 42 are mounted to the positioning frame 3 and retained by the shield 2 thereby forming a connector assembly 5. The upper and lower connectors 41, 42 are covered and electrically shielded by corresponding upper and lower shells 413, 423.

The common shield 2 has a middle wall 22 and two side walls 21, 23 perpendicularly extending from opposite sides of the middle wall 22. A cover 24 perpendicularly extends from a top edge of the middle wall 22 and forms a pair of spaced arcuate contacting tabs 242 extending forward for electrically engaging with the upper shell 413 of the upper connector 41. A pair of curved projections 224 respectively extends inward from front edges of the side walls 21, 23 for engaging with the positioning frame 3. A positioning lug 25 first downwardly and then inwardly extends from a bottom edge of each wall 21, 22, 23 for retaining the connector assembly 5 to a circuit board (not shown). Two pairs of engaging openings 232 is inwardly formed in each side wall 22, 23 and vertically align with each other for engaging with the corresponding upper and lower connectors 41, 42.

Figure 3:
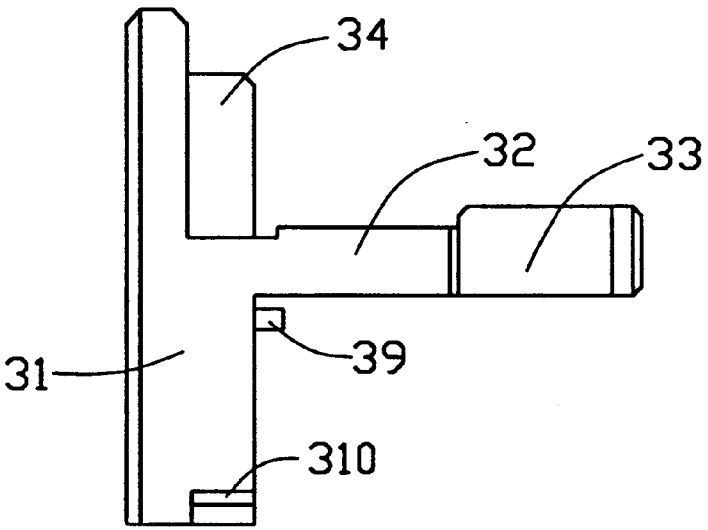
FIG. 3 is a lateral view of the positioning frame in FIG. 2.
Figure 2:
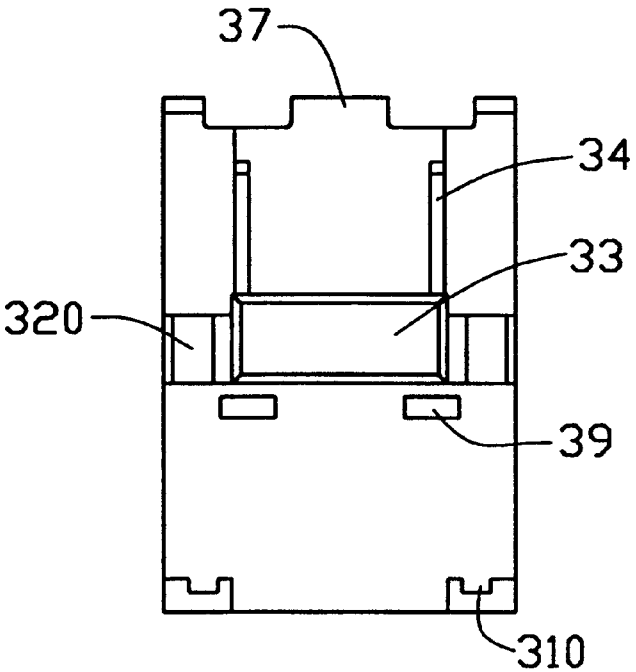
FIG. 2 is a front view of a positioning frame in FIG. 1.
Figure 4:
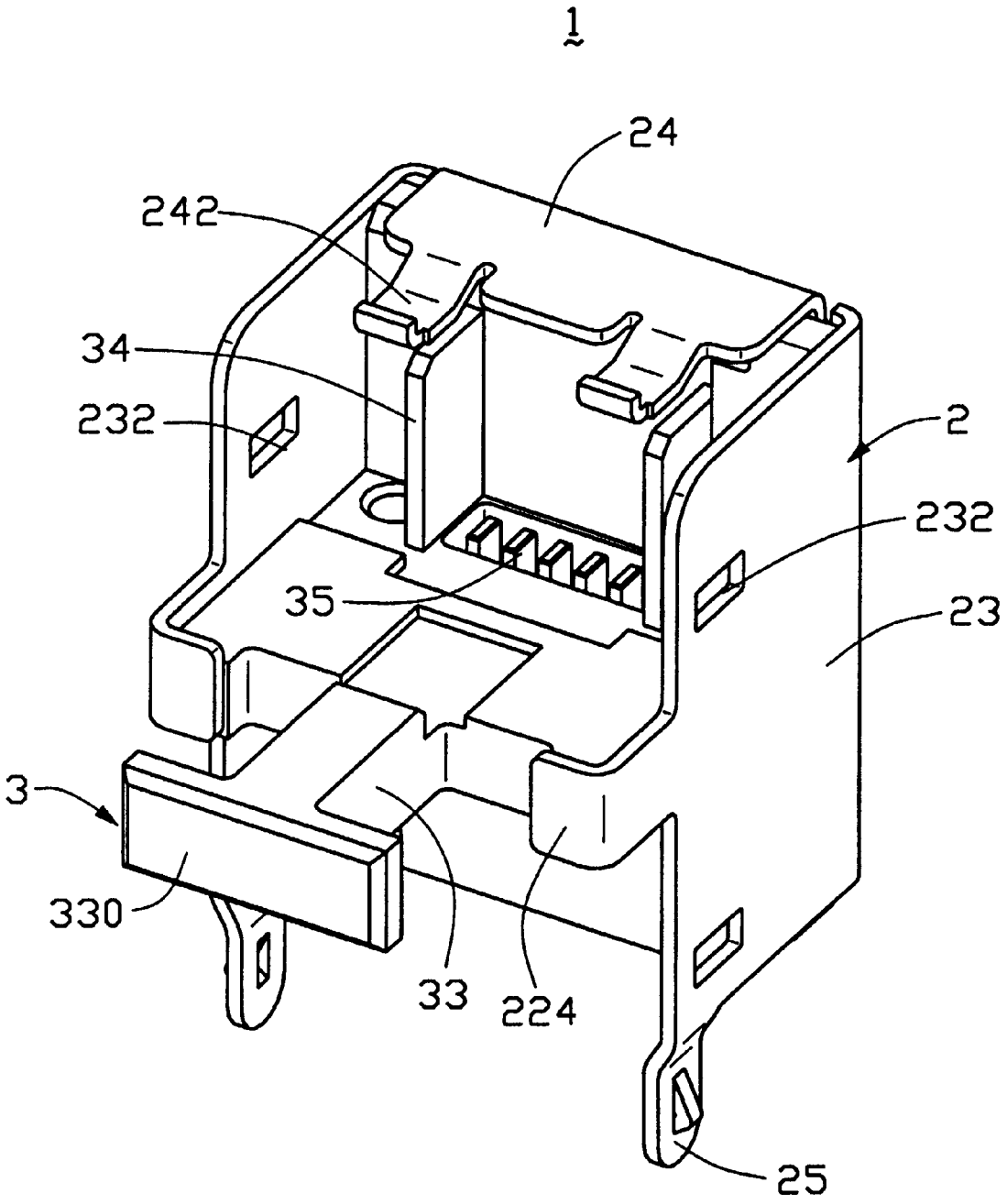
FIG. 4 is an assembled view of the positioning shielding arrangement in FIG. 1.

Also referring to FIGS. 2 and 3, the positioning frame 3 comprises a rear base wall 31 and a partition 32 extending forward from a middle portion of the rear base wall 31 for supporting the upper connector 41 thereon. The partition 32 divides the rear base wall 31 into upper and lower sections against which the upper and lower connectors 41, 42 respectively abut. The lower section is thicker than the upper section for the purpose of shifting terminals (not shown) of the upper and lower connectors 41, 42 with respect to each other. A positioning member 33 extends forward from a middle portion of a front edge of the partition 32 for preventing the upper and lower connectors 41, 42 from rotation. Three abutting bumps 37 are formed on a top edge of the base wall 31 for engaging with the cover 24 of the common shield 2 and a pair of engaging protrusions 320 is formed on the front edge of the partition 32 on opposite sides of the positioning member 33 for engaging with the curved projections 224 of the common shield 2 thereby securing the shield 2 to the positioning frame 3.

A terminal spacing is formed between the partition 32 and the base wall 31 comprising a plurality of separating ribs 350 defining spaced channels 352 therebetween for receiving and properly positioning the terminals of the upper connector 41. A pair of abutting tabs 34 is formed on the partition 32, preferably on opposite sides of the terminal spacing portion 35 for abutting against a rear portion 412 of the upper connector 41. Preferably, the abutting tabs 34 contact or extend from the base wall 31 for supporting force applied to the upper connector 41 during a mating process. Positioning holes 322 are defined in the partition 32 for receiving positioning posts 411 of the upper connector 41 thereby properly positioning the upper connector 41 with respect to the positioning frame 3.

A pair of engaging tabs 39 forwardly extends from the base wall 31 under the partition 32 for engaging with corresponding holes (not shown) defined in the lower connector 42. A pair of positioning bumps 310 downwardly extends from a bottom edge of the base wall 31 for engaging with and retaining the lower connector 42. The upper and lower shells 413, 423 respectively enclose and shield the upper and lower connector 41, 42 and are in electrical connection with the common shield 2 thereby forming a complete shielding system for the stacked connector assembly 5. The upper and lower shells 413, 423 are substantially the same except that the lower shell 423 has a pair of positioning lugs 424 downwardly extending therefrom. Each of the upper and lower shells 413, 423 respectively forms a pair of dimples 415, 425 on opposite sides thereof for engaging with the corresponding engaging openings 232 of the common shield 2. The upper and lower connectors 41, 42 are substantially the same and each has a pair of positioning posts 411, 421 extending beyond the upper and lower shells 413, 423. The positioning posts 421 downwardly extend beyond the shield 2 for engaging with corresponding holes defined in the circuit board.

In assembly, the positioning frame 3 is first received in the common shield 2 and retained in position by the engagement between the abutting bumps 37 of the positioning frame 3 and the cover 24 of the shield 2 and the engagement between the projections 224 of the shield 2 and the protrusions 320 of the positioning frame 3. The positioning lug 25 extending from the middle wall 22 of the common shield 2 is served as to support the rear base wall 31 of the positioning frame 3.

The lower connector 42 is then positioned under the partition 32 of the positioning frame 3. The engaging tabs 39 engage with a rear portion of the lower connector 42. The positioning bumps 310 engage with the positioning posts 421 of the lower connector 42. The legs 424 are aligned with the corresponding positioning lugs 25 of the common shield 2. The dimples 425 of the lower shell 423 engage with the corresponding engaging openings 232 of the common shield 2 for preventing the lower connector 43 from slipping downwardly off the common shield 2. Thus, the lower connector 42 is properly positioned with the positioning and shielding arrangement 1. The corresponding dimples 232 of the common shield 2 engage with opposite sides of the lower shell 423 of the lower connector 42.

Finally, the upper connector 41 is fixed to the positioning and shielding arrangement 1. The terminals of the upper connector 41 are positioned within the channels 352 of the terminal spacing portion 35 of the positioning frame 3. The abutting tabs 34 abut against a rear portion 412 of the upper connector 41. The positioning posts 411 are received in the holes 322. The corresponding dimples 415 of the upper shell 413 engage with the corresponding engaging openings 232 of the common shield 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An arrangement for positioning and shielding a stacked electrical connector assembly including at least an upper connector and a lower connector, the upper and lower connectors both having terminals retained therein and electrically shielded by corresponding upper and lower shells, the arrangement comprising:

a positioning frame including a vertical base wall for positioning and preventing the upper and lower connectors from withdrawal when corresponding mating connectors are made to engage with the upper and lower connectors, a partition outwardly extending from the base wall for supporting the upper connector and for separating the upper and lower connectors from each other, and a positioning member outwardly extending from a front end of the partition for engaging with and preventing the upper and lower shells of the upper and lower connectors from rotation, a terminal spacing portion being formed in the partition and being adjacent to the base wall for positioning the terminals of the upper connector, a pair of abutting tabs being formed on opposite sides of the terminal spacing portion for abutting against a rear portion of the upper connector thereby preventing the upper connector from withdrawal and rotation, a pair of engaging tabs extending from the base wall under the partition for engaging with a rear portion of the lower connector thereby retaining the lower connector with the positioning frame; and a common metal shield for receiving the positioning frame, the common shield having a middle wall, two side walls respectively extending from opposite sides of the middle wall, and a cover perpendicularly extending from a top edge of the middle wall, a pair of engaging dimples being inwardly formed in each side wall for engaging with the upper and lower shells of corresponding upper and lower connectors;

wherein a top edge of the base wall of the positioning frame abuts against and supports the cover of the common shield, a pair of engaging protrusions extending from the front end of the partition on opposite sides of the positioning member for engaging with the common shield, a pair of curved projections respectively extending inward from lateral edges of the side walls connecting with the middle side wall of the common shield, a positioning lug first inwardly and then downwardly extending from a bottom edge of each of the middle wall and the two side walls of the common shield for supporting the connector assembly and for connecting to a circuit board:

wherein the base wall is divided into upper and lower sections by the partition, and the lower section is thicker than the upper section for abutting against a rear portion of the lower connector thereby preventing the lower connector from withdrawal when a corresponding mating connector is made to mate with the lower connector;

wherein the positioning member forms an expanded portion at a front distal end thereof for engaging with the upper and lower shells of the upper and lower connectors;

wherein the terminal spacing portion of the positioning frame defines a plurality of channels therebetween for positioning the terminals of the upper connector therein;

wherein a pair of positioning bumps is formed on a bottom edge of the base wall of the positioning frame for engaging with corresponding positioning posts, which outwardly and downwardly extend beyond the rear portion of the lower connector;

wherein an abutting bump is formed on the top edge of the base wall of the positioning frame for abutting against and supporting the cover of the common shield;

wherein the engaging dimples formed in each side wall of the common shield are vertically aligned with each other.

2. A stacked connector assembly comprising:

a positioning frame having a base wall, a partition extending from the base wall and a positioning member extending from a front end of the partition;

an upper connector being positioned on the partition of the positioning frame, the upper connector having an insulative upper housing retaining a plurality of terminals therein and an upper metal shell surrounding the upper housing;

a lower connector being positioned under the partition of the positioning frame, the lower connector having an insulative lower housing retaining a plurality of terminals therein and a lower shell surrounding the lower housing; and a shielding metal common shield receiving the positioning frame therein and cooperating with the upper and lower shells of the upper and lower connectors;

wherein a terminal spacing portion is formed in the partition and being adjacent to the base wall of the positioning frame for positioning corresponding end sections of the terminals of the upper connector, a pair of abutting tabs being formed on opposite sides of the terminal spacing portion for abutting against a rear portion of the upper connector thereby preventing the upper connector from rearward withdrawal when a corresponding first mating connector is made to mate with the upper connector, a pair of engaging tabs extending from the base wall under the partition for engaging with a rear portion of the lower connector thereby retaining the lower connector with the positioning frame:

wherein the common shield forms a middle wall, two side walls respectively extending from opposite sides of the middle wall, and a cover perpendicularly extending from a top edge of the middle wall;

wherein an abutting bump is formed on a top edge of the base wall of the positioning frame for abutting against and supporting the cover of the common shield;

wherein a pair of curved projections respectively extends inwardly from lateral edges of the two side walls of the common shield;

wherein a pair of engaging protrusions extends from the front end of the partition on opposite sides of the positioning member for engaging with corresponding curved projections of the common shield;

wherein a positioning lug first inwardly and then downwardly extends from a bottom edge of each of the three consecutive side walls of the common shield for supporting the connector assembly and for connecting to a circuit board;

wherein a pair of engaging dimples is inwardly formed in each side wall of the common shield and is vertically aligned with each other for respectively engaging with corresponding upper and lower shells of the upper and lower connectors.

* * * * *